US005903204A

United States Patent [19]

Schmitz et al.

[11] Patent Number: 5,903,204

[45] Date of Patent: May 11, 1999

[54] ELECTROMAGNETIC ACTUATOR ARMATURE HAVING EDDY CURRENT-REDUCING MEANS

[75] Inventors: Günter Schmitz; Martin Pischinger, both of Aachen, Germany

[73] Assignee: FEV Motorentechnik GmbH & Co. KG, Aachen, Germany

[21] Appl. No.: 09/058,961

[22] Filed: Apr. 13, 1998

[30] Foreign Application Priority Data

Apr. 11, 1997 [DE] Germany ..... 297 06 491

[51] Int. Cl.[6] ..... H01F 7/08

[52] U.S. Cl. ..... 335/227; 251/129.1

[58] Field of Search ..... 335/220, 222, 335/227, 236, 256, 261, 266, 270, 273, 279; 251/129.1, 129.13, 129.15, 129.16, 129.18, 129.19

[56] References Cited

U.S. PATENT DOCUMENTS 4,527,139 7/1985 Bohg et al. ..... 335/256
4,673,163 6/1987 Kushida et al. ..... 251/129.1
5,207,410 5/1993 Wakeman ..... 251/129.15
5,690,064 11/1997 Izuo ..... 251/129.1

FOREIGN PATENT DOCUMENTS 35 00 530 10/1986 Germany .

*Primary Examiner*—Lincoln Donovan
*Attorney, Agent, or Firm*—Venable; Gabor J. Kelemen

[57] ABSTRACT

An electromagnetic actuator for operating a setting member includes an electromagnet composed of a yoke body and a magnet coil held by the yoke body; an armature adapted to be coupled to the setting member; and a resetting spring for exerting a spring force to the armature. The spring force opposes the magnetic force generated by the electromagnet when energized. The armature is guided in a reciprocating motion which it executes in a direction of armature displacement in response to the magnetic and spring forces. The armature is provided with a plurality of throughgoing, slot-shaped apertures.

8 Claims, 1 Drawing Sheet

7
1.11
3
1
1.1
4
10
6
5
1.2
A
4
2.11
2
3
2.1
2.2
3
8
9
10
5
6
B

ELECTROMAGNETIC ACTUATOR ARMATURE HAVING EDDY CURRENT-REDUCING MEANS

CROSS REFERENCE TO RELATED APPLICATION

This application claims the priority of German Application No. 297 06 491.6 filed Apr. 11, 1997, which is incorporated herein by reference.

BACKGROUND OF THE INVENTION

An electromagnetic actuator for operating a setting member has an electromagnet energized by a controllable current supply. The magnetic force resulting from the energization of the electromagnet affects an armature which is coupled to the setting member to be operated. Usually a resetting spring is provided which, in the de-energized state of the electromagnet, holds the armature—and the setting member connected therewith—in a first switching position. The armature, upon energization of the electromagnet, is moved towards the second switching position by the magnetic forces and is held in such a second switching position as long as the electromagnet is in an energized state.

For affecting the velocity of the armature as it approaches the pole face of the electromagnet and also, as the armature moves away from the pole face after de-energization of the electromagnet, a rapid change in the magnetic force is a desideratum. Such a rapid force change, that is, a rapid change in the magnetic field, however, is opposed by eddy currents. Conventionally, the generation of eddy currents in the electromagnet may be minimized by making the yoke body of a stack of sheet metal laminae. Thus, the energization of the electromagnet, especially during a phase when the armature is still at a significant distance from the pole face, results in a rapid build-up of the magnetic field, as described in German Offenlegungsschrift (application published without examination) No. 35 00 530. During the terminal phase of the approach of the armature, however, the effect of the electromagnet is influenced by the armature to an increasing extent. Since the armature is, as a rule, made of solid iron, the eddy currents generated therein work against a rapid field change and thus oppose a rapid change of the electromagnetic force. The same phenomenon occurs as the armature moves away from the pole face. While upon de-energization of the electromagnet only small eddy currents are present in a laminated yoke body, the eddy currents which flow in the solid iron armature even after a de-energization of the electromagnet, delay the release of the armature from the pole face. Such a "sticking" of the armature to the pole face leads to disadvantages in case of high switching frequencies and adversely affects a reproducible control of the setting member.

SUMMARY OF THE INVENTION

It is an object of the invention to provide an improved electromagnetic actuator of the above-outlined type from which the discussed disadvantages are eliminated.

This object and others to become apparent as the specification progresses, are accomplished by the invention, according to which, briefly stated, the electromagnetic actuator for operating a setting member includes an electromagnet composed of a yoke body and a magnet coil held by the yoke body; an armature adapted to be coupled to the setting member; and a resetting spring for exerting a spring force to the armature. The spring force opposes the magnetic force generated by the electromagnet when energized. The armature is guided in a reciprocating motion which it executes in response to the magnetic and spring forces in a direction of armature displacement. The armature is provided with a plurality of throughgoing, slot-shaped apertures.

The slot-shaped apertures effect a significant reduction in the generation of eddy currents even in a solid ferromagnetic armature. The result is a feasibility of a rapid field change by altering the current supplied to the electromagnet, leading to a more rapid effect on the motion of the armature. Thus, by reducing the generation of eddy currents in the armature, for example, the possibility is provided to regulate the current supply during the phase when the approaching armature is close to the pole face such that only a slight, path-dependent force excess relative to the resetting force of the spring is present. The result is a reduction in the velocity of the armature as it impacts on the pole face. After such a gentle arrival of the armature at the pole face, the current supplied to the electromagnet may be increased to thus ensure that the armature is securely held on the pole face without the risks of a rebound. After such a phase of increased holding current, the current may again be reduced so that the armature is held on the pole face with a lesser magnetic force which, nevertheless, overcomes the force of the resetting spring.

A reduction of eddy currents in the armature is also advantageous as concerns processes which recognize the position of the armature when in engagement with the pole face. The eddy currents present in a solid-iron armature have made it heretofore practically impossible to derive an unequivocal signal from the cycling frequency of a cycled holding current or from an evaluation of a current/time or voltage/time function, because the change of the inductivity and the change of the eddy currents in the armature have at least partially compensated each other precisely in the operational regions of interest. In contrast, a reduction of the eddy current generation in the armature according to the invention leads to unequivocal and reproducible signals which may be used for the regulation and/or control of the current supply of the electromagnet.

The starting of the armature motion from the pole face too, is advantageously affected by reducing the eddy current generation in the armature. While in case of a solid armature the motion start is delayed by the eddy currents present even after the de-energization of the coil current, in an eddy current-poor armature structured according to the invention the decay of the magnetic force is significantly accelerated and thus the "sticking" period is reduced.

The "slot-shaped apertures" within the meaning of the invention encompass an armature which is at least partially composed of a plurality of side-by-side arranged, interconnected sheet metal parts.

According to the invention, the depth dimension of the apertures provided in the armature extends substantially perpendicularly to the principal plane of a flat, plate-like armature. According to an advantageous feature of the invention, the length dimension of the slots is oriented in the armature plane substantially parallel to the external contour of the armature. Such an arrangement of the apertures is similar to a laminated body as concerns the suppression of eddy currents.

According to a further feature of the invention, the apertures are filled with a damping material which has a poor electric conductivity, if any. It is an advantage of this feature that natural mechanical resonances of the armature are suppressed by the armature itself.

The provision of slot-like apertures in the armature according to the invention, results by itself in a noticeable reduction of eddy currents in an armature made of solid iron. A further improvement may be achieved by making the armature of a sintered ferromagnetic material or constructing the armature of parallel-oriented sheet metal parts.

In accordance with a further feature of the invention, the yoke body of the electromagnet and the armature have an essentially rectangular outline. An electromagnetic actuator of such a configuration permits a close side-by-side disposition of several actuators as it is necessary, for example, for operating cylinder valves (constituting the setting members operated by the electromagnetic actuator) in a reciprocating piston-type internal-combustion engine. In such an arrangement it is a further advantage of the slot-like apertures provided in the armature according to the invention that a forced alignment of the armature occurs. The orientation of the laminae of the yoke body and/or the orientation of the slot-like apertures in the armature result in a reduced magnetic resistance in the direction of the laminae or in the direction of the slots, and the magnetic force always seeks to align the armature with the smallest magnetic resistance. In this manner a self-alignment of the armature occurs which opposes any torque seeking to turn the armature about an axis that is parallel to the direction of armature reciprocation. Such a self-alignment is of significance in narrow, rectangular actuator constructions.

In electromagnets having a rectangular outline it is of particular advantage to provide the pole face of the yoke body with recesses which accommodate the magnet coil and which extend essentially parallel to the opposite outer edges of the yoke body and further, to so arrange the apertures in the armature that their length dimension is oriented essentially perpendicularly to the length of the recesses in the pole face. It is of particular advantage to construct the yoke body from individual sheet metal laminae which are oriented perpendicularly to the pole face and transversely to the recesses in the pole face. The above-discussed self-alignment is particularly effective in electromagnets of such a construction.

DESCRIPTION OF THE PREFERRED EMBODIMENT

Figures 1, 2:
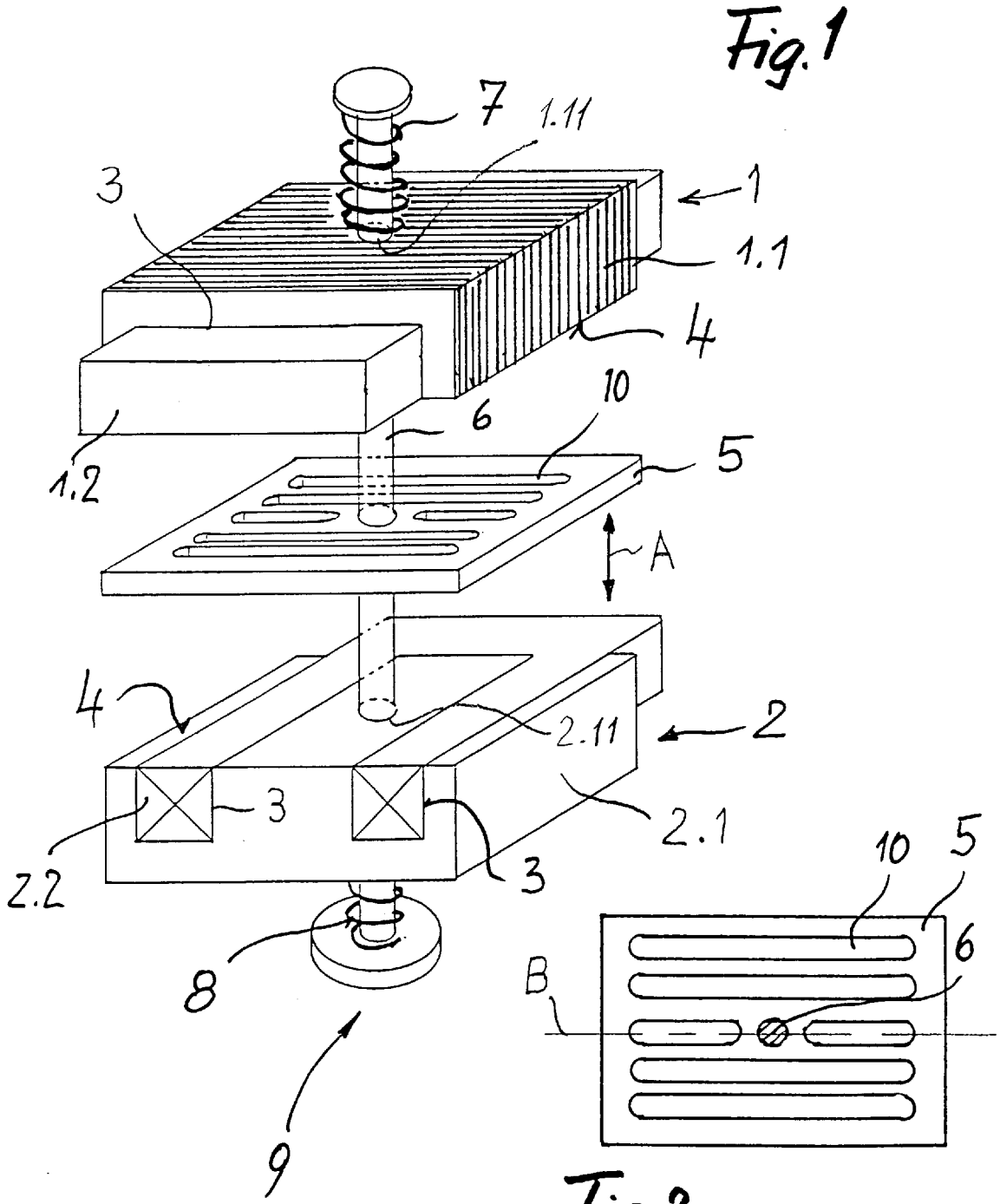
FIG. 1 is a schematic perspective view of an electromagnetic actuator for operating a cylinder valve, according to a preferred embodiment of the invention.
FIG. 2 is a top plan view of a component illustrated in FIG. 1.

The electromagnetic actuator illustrated in FIG. 1 is formed of two electromagnets 1 and 2 having a rectangular outline and each including a respective laminated yoke body 1.1 and 2.1. The sheet metal laminae forming a lamina stack are oriented—as shown for the yoke body 1.1—parallel to the length of the rectangle.

Each yoke body 1.1 and 2.1 is provided with recesses 3 which extend transversely to the yoke laminae and in which respective magnet coils 1.2 and 2.2 are arranged. The magnet coils have a rectangular outline and are so disposed relative to their associated yoke body that two parallel coil legs are received by the recesses 3, while the other two parallel coil legs extend externally of the yoke body, as shown for the electromagnet 1. It is noted that the frontal, outwardly extending leg of the coil 2.2 associated with the electromagnet 2 is cut off for better visibility.

The two electromagnets 1 and 2 are spaced from one another and their respective pole faces 4 are oriented towards one another. Between the two pole faces 4 of the electromagnets 1 and 2 an armature 5 is arranged which is fixedly connected with a guide rod 6 and which is guided for a back-and-forth motion in a direction A in openings 1.11 and 2.11 provided in the yoke bodies 1.1 and 2.1 against the resetting force of resetting springs 7 and 8 as the electromagnets 1 and 2 are alternatingly energized. As an example, the setting member 9 to be operated by the electromagnetic actuator is a cylinder valve of a reciprocating, piston-type internal-combustion engine.

The electromagnetic actuator is illustrated in FIG. 1 in a de-energized state. If the electromagnet 1 is energized, the armature 5 moves against the force of the resetting spring 7 towards the pole face 4 of the yoke body 1.1 and arrives into engagement therewith and is held there as long as the coil 1.2 is supplied with current. If the electromagnet 1 is de-energized and the electromagnet 2 is energized, the armature moves first under the effect of the resetting force of the armed spring 7 in the direction of the pole face 4 of the yoke body 2.1 and thereafter, as a result of its kinetic energy, it moves beyond the position of equilibrium between the two resetting springs 7 and 8. Subsequently, the armature 5, in the course of its motion towards the pole face 4 of the yoke body 2.1, arrives under the effect of the magnetic force of the energized electromagnet 2 and is, against the then-effective force of the resetting spring 8, brought into engagement with the pole face 4 of the yoke body 2.1. Corresponding to the cycle of the alternating energization of the electromagnets 1 and 2, the cylinder valve 9 may be accordingly opened and closed.

Also referring to FIG. 2, to prevent—to a large extent—the generation of eddy currents in the armature 5 made of a solid iron material, the armature 5 is provided with a plurality of throughgoing apertures (elongated slot-shaped holes) 10 whose depth dimension is oriented essentially perpendicularly to the main armature plane. As shown in FIG. 1, the armature 5 is a flat, plate-shaped component, whose main plane extends parallel to the two opposite large armature faces. The length dimension of the holes 10 is oriented parallel to the external contour of the armature 5; in the illustrated embodiment such length dimension is parallel to the longitudinal axis B of the rectangular shape of the armature 5. By virtue of such an arrangement of the apertures 10 the magnetic resistance of the armature 5 transversely to the orientation of the holes 10 is reduced. Such a reduction of the magnetic resistance occurs for reasons similar to a likewise reduction in the yoke bodies due to the orientation of the laminae in the yoke bodies. In this manner, on the one hand, the generation of eddy currents under the influence of an increasing magnetic field is reduced in the armature and, on the other hand, the decay of the magnetic field is accelerated, for example, upon switching off the current supplied to the coils of the electromagnet. Thus, there is obtained a reduction of the magnetic countereffect which is exerted by the armature 5 upon its approach towards an energized electromagnet or upon de-energization of a magnet when the armature is in engagement with the pole face. This means that as the armature 5 approaches the pole face 4 of an energized electromagnet, because of the reduced countereffect of the generated eddy currents (by virtue of an armature having slot-shaped holes 10), a lesser current may be used to overcome the opposing force of the counteracting resetting spring than in conventional arrangements where the armature is made of a solid material. The same applies also to the decay of the electromagnetic forces upon de-energization of the magnet coil of the electromagnet, because by virtue of the rapid decay of the eddy currents in an armature having slot-like apertures 10 according to the invention, a sticking of the armature to the pole face is prevented. As a result, the force of the compressed resetting spring may become effective at an earlier moment.

In the rectangular design of FIG. 1, a self-alignment of the armature 5 is obtained by virtue of the stack of parallel-extending laminae of the yoke bodies 1.1 and 2.1, on the one hand, and the arrangement of the slotted apertures 10 parallel to the laminae, on the other hand. Upon an external torque applied to the armature about the axis of the guide rod 6, such a self-aligning force generates a counterforce which holds the armature 5 in its defined angular position relative to the electromagnets.

The slot-like apertures 10 may be filled with an acoustically dampening material which is neither electrically nor magnetically conducting so that the natural mechanical resonances of the armature, particularly the oscillations at resonance frequency are suppressed to a substantial extent.

As it is readily apparent from FIG. 1, the electromagnetic actuator may have other applications in which the actuator has only a single electromagnet with a single resetting spring for moving the armature. One switching position in such a structure is predetermined by the position of the armature when it is in engagement with the pole face of the energized electromagnet, while the other switching position is determined when the electromagnet is de-energized and the armature assumes a position against a specifically provided abutment which is at a suitable distance from the pole face of the electromagnet.

It will be understood that the invention is not limited to the described rectangular form of the armature 5. Rather, square, oval or circular armature outlines may find application as well.

It will be understood that the above description of the present invention is susceptible to various modifications, changes and adaptations, and the same are intended to be comprehended within the meaning and range of equivalents of the appended claims.

What is claimed is:

1. An electromagnetic actuator for operating a setting member, comprising (a) an electromagnet composed of a yoke body and a magnet coil held by the yoke body;

(b) a movable armature having a direction of armature displacement and being adapted to be coupled to the setting member; said armature being plate-shaped and having a main armature plane oriented perpendicularly to said direction of armature displacement;

(c) a resetting spring for exerting a spring force to said armature; said spring force opposing a magnetic force generated by said electromagnet in an energized state thereof;

(d) means for guiding said armature in a reciprocating motion executed in response to said magnetic and spring forces in said direction of armature displacement; and (e) a plurality of throughgoing, elongated, slot-shaped holes provided in said armature; said holes having a depth dimension oriented perpendicularly to said main armature plane; said holes having a length dimension extending substantially parallel to an outer contour of said armature.

2. The electromagnetic actuator as defined in claim 1, wherein said yoke body is composed of a stack of sheet metal laminae each having a main plane oriented perpendicularly to said pole face.

3. The electromagnetic actuator as defined in claim 1, wherein said armature has a substantially rectangular outline and further wherein said length dimension of said holes extends parallel to two opposite sides of said armature.

4. The electromagnetic actuator as defined in claim 1, wherein said holes are filled with a damping material having, at the most, a poor electric conductivity.

5. The electromagnetic actuator as defined in claim 1, wherein said armature is of a sintered ferromagnetic material.

6. The electromagnetic actuator as defined in claim 1, wherein said yoke body and said armature have a substantially rectangular outline.

7. The electromagnetic actuator as defined in claim 1, wherein said yoke body has a pole face oriented towards said electromagnet and an outline having two opposite, parallel-extending edges; further comprising spaced recesses provided in said pole face for receiving at least parts of said magnet coil; said recesses having a length dimension oriented parallel to said edges; further wherein said holes have a length dimension extending perpendicularly to said length dimension of said recesses.

8. The electromagnetic actuator as defined in claim 7, wherein said yoke body is composed of a stack of sheet metal laminae each having a main plane oriented perpendicularly to said pole face and a length dimension oriented perpendicularly to said length dimension of said recesses.

* * * * *